US005112419A

United States Patent [19]

Nakagawa

[11] Patent Number: 5,112,419

[45] Date of Patent: May 12, 1992

[54] METHOD FOR PRODUCTING STRIP CABLE

[75] Inventor: Asaharu Nakagawa, Yokkaichi, Japan

[73] Assignee: Kitagawa Industries Co., Ltd., Aichi, Japan

[21] Appl. No.: 584,773

[22] Filed: Sep. 19, 1990

Related U.S. Application Data

[62] Division of Ser. No. 419,588, Oct. 10, 1989, abandoned.

[30] Foreign Application Priority Data

Oct. 12, 1988 [JP] Japan ..... 63-256429

[51] Int. Cl.[5] ..... H01B 7/08; H01B 13/22

[52] U.S. Cl. ..... 156/51; 156/55; 156/307.7; 156/245; 156/52; 264/272.11; 174/36; 427/208.2

[58] Field of Search ..... 156/47, 48, 298, 307.7, 156/273.9, 51, 55, 56, 52, 245; 264/272.11, 272.13, 272.15; 427/117, 120, 208.2; 29/841; 174/36

[56] References Cited

U.S. PATENT DOCUMENTS

| | | | |
|---|---|---|---|
| 2,900,290 | 8/1959 | Bethge | 156/298 |
| 3,089,915 | 5/1963 | Plummer | 174/36 |
| 3,168,617 | 2/1965 | Richter | 156/47 |
| 3,582,532 | 6/1971 | Plummer . | |
| 3,634,782 | 1/1972 | Marshall | 174/36 X |
| 4,375,009 | 2/1983 | Fearnside et al. | 174/36 |
| 4,409,427 | 10/1983 | Plummer, III | 174/36 |
| 4,409,431 | 10/1983 | Neuroth | 174/117 F X |
| 4,468,089 | 8/1984 | Brorein | 174/36 X |
| 4,492,815 | 1/1985 | Maros . | |
| 4,639,545 | 1/1987 | Pithouse et al. | 174/36 |
| 4,731,500 | 3/1988 | Otsuke | 174/36 |
| 4,791,236 | 12/1988 | Klein et al. | 174/36 |
| 4,822,950 | 4/1989 | Schmitt | 174/36 |
| 4,863,789 | 9/1989 | Arai | 174/35 R |
| 4,941,932 | 7/1990 | John | 156/48 |
| 4,980,223 | 12/1990 | Nakano et al. | 174/35 R X |

FOREIGN PATENT DOCUMENTS

| | | | |
|---|---|---|---|
| 0061829 | 10/1982 | European Pat. Off. . | |
| 0014812 | 1/1989 | Japan | 156/51 |
| 8603050 | 5/1986 | PCT Int'l Appl. . | |
| 1326620 | 8/1973 | United Kingdom . | |
| 2058439 | 4/1981 | United Kingdom . | |

*Primary Examiner*—Michael W. Ball
*Assistant Examiner*—Francis J. Lorin
*Attorney, Agent, or Firm*—Oliff & Berridge

[57] ABSTRACT

In the present invention, a method for producing strip cable provided on its periphery with the meshed conductive metal or the woven fiber coated with a conductive material. The method produces a flat cable having multiple signal conductive members encase in an insulating material with the mesh metal outer layer fastened to the outer surface of the insulating material. The strip cable is thus protected from electromagnetic waves. Since the strip cable fails to function as an antenna, the electronic equipment connected to the strip cable does not require a shielding material. By using the strip cable provided with a electromagnetic-shielding effect, electromagnetic waves can be avoided easily and inexpensively. In addition, the varieties of design can be allowed for the electronic equipment.

10 Claims, 1 Drawing Sheet

METHOD FOR PRODUCTING STRIP CABLE

This is a division of application Ser. No. 07/419,588 filed Oct. 10, 1989, abandonned.

BACKGROUND OF THE INVENTION

The present invention relates to a strip cable comprising multiple signal conductors and being connected to electronic equipment.

Since the strip cable receives and transmits a weak control signal for driving and controlling the electronic equipment connected to the strip cable, signal conductors composing the strip cable have a small diameter and high impedance. The strip cable is a bundle of long, thin signal conductors because it must connect electronic equipment scattered at various distances. The strip cable may function like an antenna and receive and send electromagnetic noise.

Conventionally, the strip cable is positioned far from the electronic equipment which may be a source of electromagnetic noise and each piece of electronic equipment connected to the strip cable is electromagnetically shielded, so that the strip cable will not pick up electromagnetic noise.

However, the above solution is insufficient and the following problem still remains.

Since the strip cable must be positioned far from the electronic equipment such as an electronic typewriter or a printer, the design of the electronic equipment connected to the strip cable is limited.

These days, the electronic equipment increasingly use microcomputers. To increase the processing speed of the microcomputers, the clock frequency is set at high a value. As a result, the number of electromagnetic-noise sources as well as the amount of electromagnetic noise increase. The cost for shielding the sources is also increased.

SUMMARY OF THE INVENTION

Consequently, the object of the present invention is to provide a strip cable that is easily and inexpensively shielded from electromagnetic noise and that allows a variety of the electronic equipment designs.

This object is achieved by a strip cable that is resistant to electromagnetic noise. The strip cable comprises a plurality of signal conductors coated with insulating material, and a meshed outer layer fastened to an outer surface of the insulating material. The meshed outer layer is made of conductive material for reducing electromagnetic noise on the signal conductors.

DETAILED DESCRIPTION OF THE PREFERRED EMBODIMENTS

Figure 1:
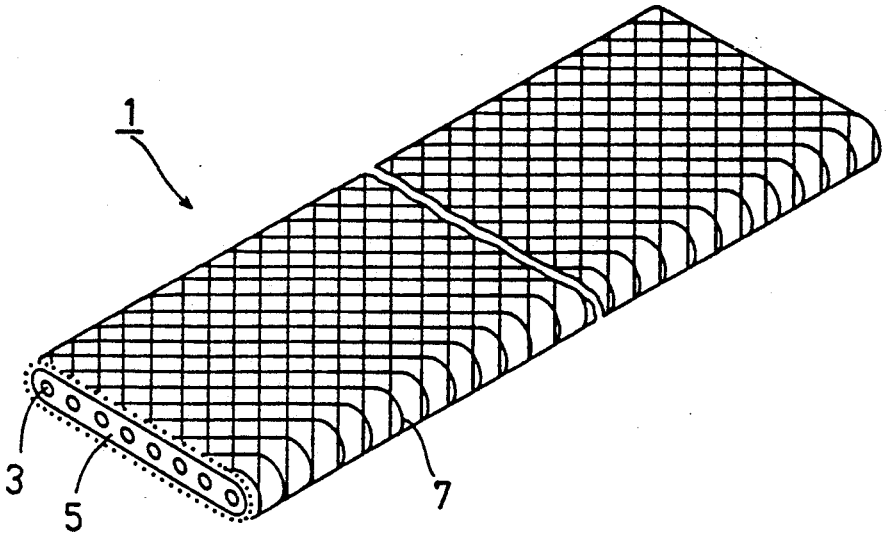
FIG. 1 is a perspective view of a flat cable for a first embodiment of the present invention.

As shown in FIG. 1, a flat cable 1 comprises eight copper signal conductors 3 arranged in parallel, an insulating layer 5 for insulating the signal conductors 3, and a meshed metal 7 adhered onto the outer periphery of the insulating layer. The meshed metal 7 is composed of copper wire with a linear diameter of 0.02 mm to 0.2 mm.

The flat cable 1 is manufactured as follows:

First, the signal conductors are arranged in parallel on the same plane of a strip-shaped metal mold. Insulating resin such as polyvinyl chloride, polyester or polyimide resin is then poured into the metal mold to form the insulating layer 5. After curing, the insulating layer 5 including the signal conductors 3 is extracted from the metal mold. Subsequently, a low-melting film composed of polyvinyl acetate, ethylene-vinyl acetate copolymer, phenoxy resin, or the like is adhered onto the outer periphery of the insulating layer 5, and the meshed metal 7 is formed on the surface of the film. Finally, by heating, the low-melting film is melted to join the meshed metal 7 with the outer periphery of the insulating layer 5. The meshed metal 7 can be coated with a low-melting film in advance, and, by heating, the meshed metal 7 can be adhered to the outer periphery of the insulating layer 5. At the same time, the low-melting film can be melted to form an insulating membrane on the meshed metal 7.

Alternatively, the opposite sides of the signal conductors 3 arranged in parallel on the same plane can be adhered to two insulating films like a sandwich. The meshed metal 7 can be adhered via the low-melting film onto the insulating films.

The flat cable 1 has the meshed metal 7 on its outer periphery, but the linear diameter of the meshed metal 7 is 0.02 mm to 0.2 mm. The meshed metal 7 is so thin that the flat cable 1 is flexible. Like the flat cable without the meshed metal 7, the flat cable 1 is compact and lightweight. Moreover, the flat cable 1 contributes to the decrease of wrongly placed wirings, and has high reliability. The flat cable 1 is connected via connectors or solders on both ends to the electronic equipment to be wired.

Since the flat cable 1 comprises the meshed metal 7 of copper which conducts electricity on its outer periphery, the signal conductors 3 are electromagnetically shielded from the outside. Consequently, electromagnetic noise is not transmitted to the signal conductors 3, and the flat cable 1 does not function as an antenna. By using the flat cable 1 of the present embodiment, the electronic equipment does not have to be shielded, and the distance between the electronic equipment and the flat cable does not have to be considered. Electromagnetic noise can be easily and inexpensively avoided. Furthermore, the electronic equipment such as an electronic typewriter can be designed without limitation.

Figure 2:
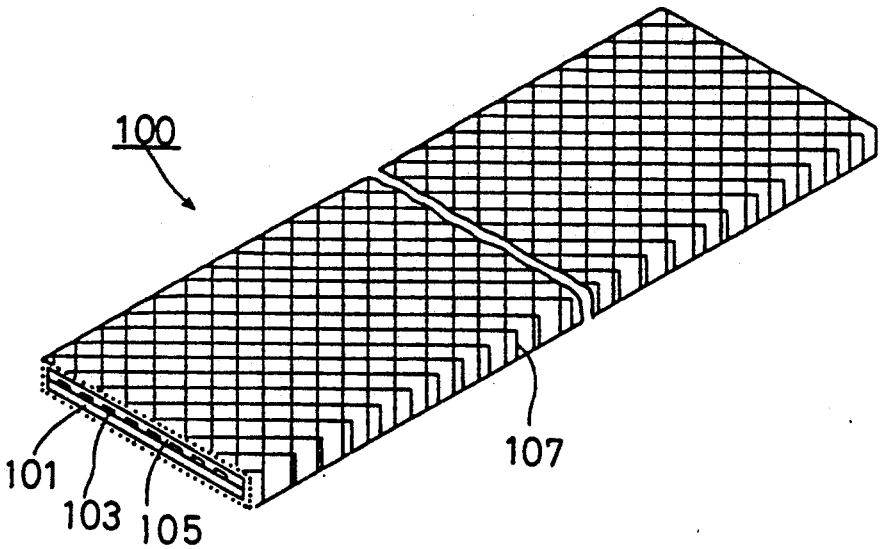
FIG. 2 is a perspective view of a flexible printed wiring board for a second embodiment of the present invention.

As shown in FIG. 2, in a second embodiment, a flexible printed wiring board 100 comprises an insulating panel 101 composed of a flexible film such as a polyester film or a polyimide film, and eight electrical wires 103 of copper foil formed in parallel on the surface of the insulating panel 101. The flexible printed wiring board 100 further comprises an insulating layer 105 coated on the electrical wires 103, and a meshed metal 107 of copper wire with the linear diameter of 0.02 mm to 0.2 mm adhered over all the surfaces of the insulating layer 105 and the insulating panel 101. The flexible printed wiring board 100 is manufactured as follows.

After a copper foil is placed on the insulating panel 101, the electrical wires 103 are formed on the insulating panel 101 through the known processes for manufacturing printed wiring boards, such as the transcription of the wiring pattern, etching, etc. Subsequently, the insulating layer 105 composed of an insulating resin such as polyvinyl chloride resin is applied onto the insulating panel 101 to coat the electrical wires 103. The meshed metal 107 is then formed all over the surfaces of the insulating layer 105 and the insulating panel 101, and is soaked in silicone resin. After the silicon resin is cured by heating and drying, the meshed metal 107 is adhered to the surfaces of the insulating layer 105 and the insulating panel 101. The meshed metal 107 can be adhered by using hot-melt adhesive such as polyvinyl acetate or ethylene-vinyl acetate copolymer.

Like the flat cable 1 of the first embodiment, the printed wiring board 100 comprising the meshed metal 107 on its outer periphery is flexible. The printed wiring board 100 is so flexible that it may be used for wiring between a thermal printing head and a printing-head controller of a thermal-head type electronic typewriter. This wiring does not interfere with the lateral movement of the thermal printing head.

In the same way as the flat cable 1 of the first embodiment, since the flexible printed wiring board 100 is covered by the meshed metal 107 of conductive copper, the electrical wires 103 are electromagnetically shielded from the outside. The electrical wires 103 fail to receive or transmit electromagnetic noise. The flexible printed wiring board 100 is prevented from functioning as an antenna. By using the flexible printed wiring board 100, the electronic equipment that generates electromagnetic noise does not require shielding. Moreover, the distance between the electronic equipment and the flexible printed wiring board 100 does not have to be considered. Consequently, electromagnetic noise can be easily and inexpensively eliminated from the flexible printed wiring board 100. In addition, a variety of designs can be allowed for the electronic equipment such as an electronic typewriter.

When the mesh size of the meshed metals 7 and 107 is altered according to the frequency of electromagnetic noise, electromagnetic noise can be shielded more precisely.

Although specific embodiments of the invention have been shown and described for the purpose of illustration, the invention is not limited to the embodiments illustrated and described. This invention includes all embodiments and modifications that come within the scope of the claims.

For example, instead of the meshed metal, woven or nonwoven fabric composed of conductive fiber or synthetic resin coated with metal can be used. The conductive fiber can be made by coating fiber with conductive metal through electroless plating or evaporation.

What is claimed is:

1. A method of manufacturing a strip cable that is resistant to electromagnetic noise, comprising the steps of:

arranging a plurality of signal conductors in the same plane in a strip-shaped metal mold;

pouring insulating resin in a liquid state into the metal mold to form an insulating layer around the plurality of signal conductors;

curing the insulating resin;

extracting the insulating layer and signal conductors from the metal mold;

forming a low-melting film onto the surface of the cured insulating resin;

adhering meshed metal onto the surface of the cured insulating resin by heating the low-melting film.

2. The method of manufacture of claim 1, in which the step of adhering the meshed metal onto the cured insulating resin comprises the steps of:

placing the meshed metal onto the low-melting film; and heating the low-melting film such that the low-melting film joins the meshed metal to the cured insulating resin.

3. The method of manufacture of claim 1, further comprising the step of coating the meshed metal with the low-melting film prior to the step of adhering the meshed metal onto the surface of the cured insulating resin.

4. The method of manufacture of claim 1, in which the insulating resin is chosen from the group consisting of polyvinyl chloride, polyester, and polyimide resin.

5. The method of manufacture of claim 1, in which the low-melting film is chosen from the group consisting of polyvinyl acetate, ethylene-vinyl acetate copolymer, and phenoxy resin.

6. A method of manufacturing a strip cable that is resistant to electromagnetic noise, comprising the steps of:

laying a first film of insulating resin in a strip-shaped mold;

arranging a plurality of signal conductors in the same plane on the first film in the strip-shaped mold;

laying a second film of insulating resin on top of the plurality of signal conductors on the first film to sandwich the plurality of signal conductors between the first and second films such that the first and second films of insulating resin form an insulating layer around the plurality of signal conductors;

curing the first and second films of insulating resin;

extracting the cured insulating resin and signal conductors from the strip-shaped mold;

forming a low-melting film onto the surface of the cured insulating resin;

adhering meshed metal onto the surface of the cured insulating resin by heating the low-melting film.

7. The method of manufacture of claim 6, in which the step of adhering the meshed metal onto the cured insulating resin comprises the steps of:

placing the meshed metal onto the low-melting film; and heating the low-melting film such that the low-melting film joins the meshed metal to the cured insulating resin.

8. The method of manufacture of claim 6, further comprising the step of coating the meshed metal with the low-melting film prior to the step of adhering the meshed metal onto the surface of the cured insulating resin.

9. The method of manufacture of claim 6, in which the insulating resin is chosen from the group consisting of polyvinyl chloride, polyester, and polyimide resin.

10. The method of manufacture of claim 6, in which the low-melting film is chosen from the group consisting of polyvinyl acetate, ethylene-vinyl acetate copolymer, and phenoxy resin.

* * * * *

UNITED STATES PATENT AND TRADEMARK OFFICE

CERTIFICATE OF CORRECTION

PATENT NO. : 5,112,419

DATED : May 12, 1992

INVENTOR(S) : Asaharu Nakagawa

It is certified that error appears in the above-identified patent and that said Letters Patent is hereby corrected as shown below:

Title page, item,

[54] change "METHOD FOR PRODUCTING STRIP CABLE" to --METHOD FOR PRODUCING STRIP CABLE--.

Signed and Sealed this

Twenty-second Day of June, 1993

*Attest:*

Michael K. Kirk

MICHAEL K. KIRK

*Attesting Officer*

*Acting Commissioner of Patents and Trademarks*